United States Patent [19]

Sagou et al.

[11] Patent Number: 4,687,825

[45] Date of Patent: Aug. 18, 1987

[54] METHOD OF MANUFACTURING PHOSPHOR SCREEN OF CATHODE RAY TUBE

[75] Inventors: Seiji Sagou; Takeo Itou, both of Fukaya, Japan

[73] Assignee: Kabushiki Kaisha Toshiba, Kabushiki, Japan

[21] Appl. No.: 776,605

[22] Filed: Sep. 16, 1985

[30] Foreign Application Priority Data

Mar. 30, 1984 [JP] Japan ..... 59-60815

[51] Int. Cl.[4] ..... B05D 3/06; B05D 5/12

[52] U.S. Cl. ..... 427/54.1; 427/71; 427/72; 427/202; 427/240; 427/346; 430/23

[58] Field of Search ..... 427/240, 71, 68, 72, 427/64, 346, 202, 54.1, 57; 430/23

[56] References Cited

U.S. PATENT DOCUMENTS 3,467,059 9/1969 Korner et al. ..... 427/68

4,025,662 5/1977 Sumner ..... 427/71

4,263,385 4/1981 Pampalone ..... 427/68

4,469,766 9/1984 Nishizawa et al. ..... 427/68

*Primary Examiner*—John D. Smith

*Assistant Examiner*—Janyce A. Bell

*Attorney, Agent, or Firm*—Cushman, Darby & Cushman

[57] ABSTRACT

A method of manufacturing a phosphor screen of a cathode ray tube, comprises forming a pattern having a particle-receptive adhesive surface on an inner surface of a faceplate having a peripheral wall, rotating the faceplate about an axis perpendicular to its inner surface and passing its center, and charging phosphor particles onto the inner surface of the faceplate during or before rotation thereof so as to allow the phosphor particles to slide on the inner surface of the faceplate and to attach to the particle-receptive adhesive surface. The method can form a phosphor film having a uniform and sufficient thickness without an irregularity in the amount of phosphor attached.

14 Claims, 4 Drawing Figures

METHOD OF MANUFACTURING PHOSPHOR SCREEN OF CATHODE RAY TUBE

BACKGROUND OF THE INVENTION

I. Field of the Invention

The present invention relates to a method of manufacturing a phosphor screen of a cathode ray tube.

II. Description of the Prior Art

A phosphor screen having red, blue and green phosphors regularly arranged (in a predetermined pattern) is arranged on the inner surface of the faceplate of a cathode ray tube, e.g., a color picture tube.

A slurry method as disclosed in Japanese Patent Publication No. 47-38054 is known as a method of manufacturing such a phosphor screen. According to this method, a phosphor slurry containing a photoresist is coated on the entire inner surface of the faceplate. The blue phosphor is exposed through a shadow mask and developed, and then, the green phosphor is exposed and developed. Finally, the red phosphor is exposed and developed.

The slurry method has the advantage of being easily mass-produced.

A powder coating method having various advantages over the slurry method has recently been developed. As disclosed in Japanese Patent Publication No. 48-14498, in the powder coating method, a photosensitive resin which can be imparted with a predetermined stickiness upon radiation and does not contain phosphor particles is coated on the inner surface of a faceplate. The coated resin is exposed through a shadow mask to form a particle-receptive adhesive surface of a predetermined pattern, and phosphor particles are allowed to attach to the particle-receptive adhesive surface. The slurry method described above has various problems including non-precise patterning due to light scattering by phosphor particles, and especially, large phosphor particles during exposure, difficult patterning of a fine pitch for high-precision patterning, degradation of phosphor characteristics depending on the photosensitive resin used, and limitation of the type of phosphors which can be used due to the problem of gelation of phosphors with the photosensitive resin. In contrast, the powder coating method is free from such problems associated with the slurry method. In addition, the powder coating method has various advantages. For example, the process is easy, and the use of water or an organic solvent in the developing step may not be necessary depending on the type of photosensitive resin used.

As a method of allowing phosphor particles to attach to a particle-receptive adhesive surface in the powder coating method, the dusting method for dispersing powder particles in the air and blowing the dispersing particles at high speed by a spray is known. However, in the dusting method, since the particles are passed through the nozzle of the spray gun at high speed, the particles produce friction and the light-emitting intensity of the phosphor particles may be lowered. Another method is disclosed in U.S. Pat. No. 4,469,766. In this method, as shown in FIG. 1, phosphor particles 3 are charged onto the inner surface of a faceplate 1 having a particle-receptive adhesive surface of a predetermined pattern thereon. The faceplate 1 is inclined along the X-X′ or Y-Y′ direction to allow the phosphor particles to slide on the faceplate inner surface, thereby allowing the particles to attach to the patterned adhesive surface.

In the above method, the adhering amount of phosphor particles can be kept substantially uniform. However, when microscopically observed, irregular streak patterns in the coating are easily formed and degrade the quality of the phosphor screen. This can be considered attributable to the phosphor particles sliding in a zigzag manner.

In addition, in this method, the adhering amount is particularly irregular at the periphery, i.e., near the outer peripheral wall of the faceplate. This is considered attributable to the fact that the sliding movement of the phosphor particles is completely stopped or slowed down upon a direction change when a mass of phosphor particles collide against the outer peripheral wall. In any event, it is difficult to keep the attaching amount of phosphor particles constant over the entire inner surface of the faceplate and to obtain a phosphor screen without irregularly coated streak patterns. These problems are not encountered in the conventional slurry method.

SUMMARY OF THE INVENTION

It is an object of the present invention to provide a method of manufacturing a phosphor screen of a cathode ray tube, wherein a phosphor layer of uniform thickness and void of coating irregularities can be formed.

A method of manufacturing a phosphor screen of a cathode ray tube according to the present invention, comprises:

forming a pattern having a particle-receptive adhesive surface on an inner surface of a faceplate having a peripheral wall;

rotating the faceplate about an axis perpendicular to its inner surface and passing its center; and charging phosphor particles onto the inner surface of the faceplate during or before rotation thereof so as to allow the phosphor particles to slide on the inner surface of the faceplate and to attach to the particle-receptive adhesive surface.

In the method of the present invention, the phosphor particles are continuously slid on the particle-receptive adhesive surface while the faceplate is continuously rotated. For this reason, no irregularity is found in the amount of phosphor particles attached over the entire inner surface of the faceplate, especially, near the peripheral wall, thereby providing a high-quality phosphor screen without irregularly coated streak patterns.

A still better effect is obtained when the rotational axis is inclined with respect to the vertical direction. The inclination angle of the axis can be selected such that a sliding range of phosphor particles covers substantially the entire particle-receptive adhesive surface during rotation of the faceplate. Such a range of inclination angle is 5 to 85 degrees with respect to the vertical direction and is preferably 20 to 70 degrees. Although the inclination angle of the rotating axis can be kept constant, it is preferably changed in accordance with the attaching state of phosphor particles during rotation of the faceplate.

The rotational frequency of the faceplate is selected such that the range of sliding movement of phosphor particles covers the entire inner surface of the faceplate. Such a range of rotational frequency is 1 to 100 rpm and is preferably 5 to 60 rpm. The rotational frequency of the faceplate can be kept constant or changed.

In the present invention, when phosphor particles are charged while rotating the faceplate, the amount and density of phosphor particles attached do not vary between portions of the faceplate on which the phosphor particles are and are not initially charged. A still better effect is obtained if phosphor particles are charged during rotation of the faceplate about the inclined rotating axis.

When the faceplate is vibrated to allow easy sliding movement of the phosphor particles in the present invention, improved film characteristics can be obtained.

According to the present invention, a shielding plate is arranged to extend inward from the peripheral wall of the faceplate in a manner not to interfere with the charging of the phosphor particles so that the phosphor particles will not scatter from the inner surface of the faceplate.

DETAILED DESCRIPTION OF THE PREFERRED EMBODIMENT

The present invention will now be described in detail by way of Examples.

EXAMPLE

Figure 2:
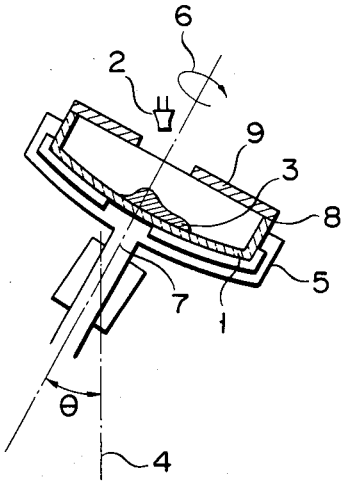
FIGS. 2 to 4 are sectional views showing steps of a method of manufacturing a phosphor screen of a cathode ray tube according to an embodiment of the present invention.
Figure 3:
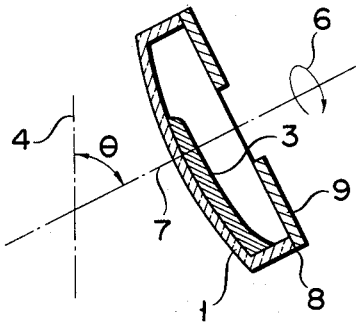
Figure 4:
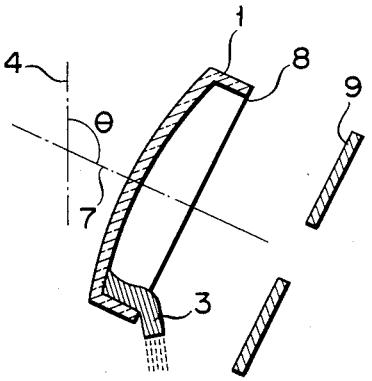

A composition for exhibiting a particle-receptive property, i.e., stickiness upon light radiation having the following composition:

Polyvinyl alcohol: 0.5% by weight
Diazonium salt: 4% by weight
Surfactant: 0.008% by weight
Water: Balance is coated on the inner surface of a faceplate 1 to a thickness of about 1 μm. The coated film is exposed through a shadow mask for about 2 minutes by a 1 kW ultra high-pressure mercury lamp arranged at about 350 mm from the inner surface of the faceplate 1 along the central axis of the faceplate 1. A particle-receptive adhesive surface pattern is thus formed on the exposed portion of the film. After the shadow mask is removed, the faceplate 1 is mounted on a rotary support 5, an inclination angle $\theta$ of a rotating axis 7 with respect to a vertical axis 4 is set at about 40 degrees, and about 30 g of blue phosphor particles 3 are charged by a supply nozzle 2, as shown in FIG. 2. An apertured shielding plate 9 is arranged to extend inward from the peripheral wall of the faceplate 1 so as not to allow the phosphor particles to scatter from the interior of the faceplate 1 during rotation of the faceplate 1. When the faceplate 1 is rotated at approximately 35 rpm about the rotating axis 7 as indicated by arrow 6, the charged phosphor particles 3 are extended over the entire inner surface of the faceplate 1. When the faceplate 1 is rotated about 100 times in this state, the blue phosphor particles 3 are uniformly attached to the particle-receptive adhesive surface pattern. After the phosphor particles are attached to the particle-receptive adhesive surface formed on the inner surface of the faceplate in this manner, the faceplate 1 is rotated at an increased inclination angle $\theta$ as shown in FIG. 3. Further, as shown in FIG. 4, the apertured shielding plate 9 is removed while increasing the inclination angle $\theta$ so that the phosphor particles 3 drop from the faceplate 1. The faceplate inner surface is faced downward along the vertical axis 4 to discharge the remaining phosphor particles 3. The so-called air phenomenon is performed for blowing extra phosphor particles by blowing dry air at a speed of about 8.5 m/sec from a spray gun arranged at a distance of about 200 mm from the inner surface of the faceplate and having 7 nozzle holes of 0.5 mm in diameter at 50 mm intervals. Thus, a predetermined blue phosphor pattern is formed. Similarly, green and red phosphor patterns are formed to complete the phosphor screen.

In this method, the charged phosphor particles continuously move on the faceplate inner surface due to the rotation of the faceplate. For this reason, the phosphor particles will not locally separate or form irregularly coated streak patterns. The amount of attached phosphor particles is particularly uniform near the peripheral wall of the faceplate.

Figure 1:
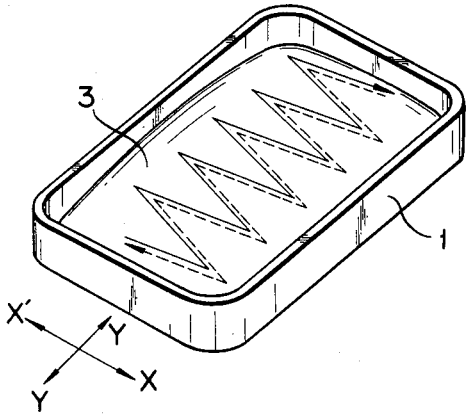
FIG. 1 (PRIOR ART)
FIG. 1 is a perspective view showing a conventional method of manufacturing a phosphor screen of a cathode ray tube.

Table 1 shows the characteristics of the phosphor screen when a blue phosphor screen prepared by the powder coating method is applied to a 19" color picture tube together with those of phosphor screens prepared by the conventional methods. The conventional methods were the dusting method described above and the X-Y inclination method shown in FIG. 1. The transmittance is a value for the phosphor attached portion with respect to white visible light. The brightness is obtained when the color cathode ray tube is operated at an acceleration voltage of 25 kV and IK=500 μA and is a relative value with reference to that of the screen prepared by the dusting method.

TABLE 1

| | Characteristics of Phosphor Screen Obtained by Powder Coating Method | | | | |
|---|---|---|---|---|---|
| | Film Thickness ($mg/cm^2$) | Film Thickness Variation | Transmittance | Brightness | Irregularity |
| Dusting Method | 2.3 | ±10% | 48% | 100 | Irregular at the center 1 |
| X-Y Inclination Method | 2.8 | ±5% | 41% | 130 | Irregular at periphery |
| Example | 3.2 | ±3% | 37% | 140 | No irregularity |

As can be seen from Table 1, the phosphor screen of the Example of the present invention has a sufficient film thickness, a small film thickness variation, less coating irregularity and a higher brightness. It is also seen from the relationship between the film thickness and the transmittance that the packing ratio of phosphor particles, i.e., the density is highest.

A tricolor phosphor screen of blue, green and red phosphors was prepared in a similar manner, and Table 2 shows the ratios of inclusion of the phosphors of the respective colors into other phosphors and the coating irregularity state on the screen surfaces. The inclusion ratios were measured with a microscope while illuminating the screens with ultraviolet rays.

TABLE 2

| | State of Phosphor Screen Obtained by Powder Coating Method | | | |
|---|---|---|---|---|
| | Green Phosphor Included in Blue Phosphor | Red Phosphor Included in Blue Phosphor | Red Phosphor Included in Green Phosphor | Irregularity |
| Dusting Method | about 0.5% | about 0.8% | about 0.7% | Irregular at the center |

TABLE 2-continued

| | State of Phosphor Screen Obtained by Powder Coating Method | | | |
|---|---|---|---|---|
| | Green Phosphor Included in Blue Phosphor | Red Phosphor | Red Phosphor Included in Green Phosphor | Irregularity |
| X-Y Inclination Method | about 0.12% | about 0.17% | about 0.17% | Irregular at the periphery and center |
| Example | about 0.05% | about 0.1% | about 0.15% | No irregularity |

As can be seen from Table 2, the phosphor screen of the Example of the present invention has small ratios of color mixing of phosphors and less coating irregularity. The screen of the Example thus has a high quality.

In the Example described above, the inclination angle of the rotating axis 7 is set at 40 degrees. However, the inclination angle is not limited to this. According to an experiment conducted, when the inclination angle exceeded 85 degrees, most of the phosphor particles collected near the peripheral wall of the faceplate 1 and the phosphor film could not then be easily formed at the center of the faceplate. However, when the inclination angle was less than 5 degrees, the effect of inclining the rotating axis 7 could not be obtained. Thus, a preferable result was obtained when the inclination angle of the rotating axis was 5 to 85 degrees, and a most preferable result was obtained when the angle was 20 to 70 degrees.

The phospnor particles 3 can be charged while the inclination angle $\theta$ is 0 degrees, i.e., while the inner surface of the faceplate 1 faces upward, and then the inclination angle $\theta$ can be gradually changed while rotating the faceplate 1. Note that the phosphor particles 3 are preferably charged while rotating the faceplate 1.

When phosphor particles are charged before rotating the faceplate, slight variations occur in the packing density or the amount of phosphor particles attached at the charged portion, and the faceplate must be rotated for a long period of time in order to compensate for such variations.

In the above Example, the rotational frequency of the faceplate 1 was 35 rpm. However, the rotational frequency is not limited to this value. The rotational frequency must be selected in combination with the inclination angle $\theta$ of the rotating axis 7 such that the phosphor particles 3 slide over the entire inner surface of the faceplate 1. According to an experiment conducted, when the rotational frequency of the faceplate was less than 1 rpm, sliding movement of the phosphor particles became discontinuous and coating irregularity easily occurred. When the rotational frequency exceeded 100 rpm, most of the phosphor particles 3 scattered to the peripheral wall of the faceplate 1 and the phosphor film was not formed at the center of the faceplate. The best result was obtained when the rotational frequency of the faceplate was within the range of 5 to 60 rpm.

A phosphor screen having a uniform phosphor attachment amount can be obtained when the rotating axis 7 is vibrated from a location (not shown) in the above Example. Vibration can be provided by a vibrator or by an ultrasonic oscillator.

What is claimed is:

1. A method of manufacturing a phosphor screen of a cathode ray tube, comprising:

forming a pattern having a particle-receptive adhesive surface on an inner surface of a face plate having a peripheral wall;

rotating said face plate at a rotational frequency of 1 to 100 rpm about an axis perpendicular to an inner surface thereof and passing a center thereof, the axis of the face plate being inclined with respect to a vertical axis; and charging phosphor particles onto the inner surface of said face plate during or before rotation thereof so as to allow the phosphor particles to slide on the inner surface of said face plate and to attach to said particle-receptive adhesive surface.

2. A method according to claim 1, wherein an angle formed between the axis of said faceplate and the vertical axis is selected so that the phosphor particles slide over the entire inner surface of said faceplate.

3. A method according to claim 2, wherein the angle is 5 to 85 degrees.

4. A method according to claim 3, wherein the angle is 20 to 70 degrees.

5. A method according to claim 2, wherein the angle is changed during rotation of said faceplate.

6. A method according to claim 5, wherein the angle is increased during rotation of said faceplate.

7. A method according to claim 1, wherein a rotational frequency of said faceplate is selected so that the phosphor particles slide over the entire inner surface of said faceplate.

8. A method according to claim 1, wherein the rotational frequency of said faceplate is 5 to 60 rpm.

9. A method according to claim 7, wherein the rotational frequency of said faceplate is changed during rotation of said faceplate.

10. A method according to claim 1, wherein the phosphor particles are charged during rotation of said faceplate.

11. A method according to claim 10, wherein the phosphor particles are charged while an axis of said faceplate is inclined with respect to a vertical axis and said faceplate is being rotated.

12. A method according to claim 1, wherein said faceplate is vibrated so as to facilitate the sliding movement of the phosphor particles on the inner surface of said faceplate.

13. A method according to claim 1, wherein said faceplate has a shielding plate which extends from the top of the peripheral wall toward a rotating axis thereof and prevents the scattering of the phosphor particles.

14. A method according to claim 1, wherein said pattern having said particle-receptive adhesive surface is obtained by coating a material capable of being imparted with a stickiness by light radiation on the inner surface of said faceplate and then exposing the coating film through a shadow mask.

* * * * *

UNITED STATES PATENT AND TRADEMARK OFFICE

CERTIFICATE OF CORRECTION

PATENT NO. : 4,687,825

DATED : August 18, 1987

INVENTOR(S) : Sagou et al

It is certified that error appears in the above-identified patent and that said Letters Patent is hereby corrected as shown below: Title page:

At Box [73] address of Assignee should read Kawasaki-shi, Japan

At Box [30] Foreign Application Priority Data is not applicable. This is a non-convention application.

Signed and Sealed this

Twenty-third Day of February, 1988

*Attest:*

*Attesting Officer*

DONALD J. QUIGG

*Commissioner of Patents and Trademarks*